US008708591B2

(12) United States Patent
Shepard, Jr.

(10) Patent No.: US 8,708,591 B2
(45) Date of Patent: Apr. 29, 2014

(54) GOLF CLUB CLEANER WITH DETACHABLE BRUSH

(71) Applicant: Leon M. Shepard, Jr., Miramar, FL (US)

(72) Inventor: Leon M. Shepard, Jr., Miramar, FL (US)

( * ) Notice: Subject to any disclaimer, the term of this patent is extended or adjusted under 35 U.S.C. 154(b) by 0 days.

(21) Appl. No.: 13/629,568

(22) Filed: Sep. 27, 2012

(65) Prior Publication Data

US 2014/0082869 A1 Mar. 27, 2014

(51) Int. Cl.
*A46B 11/00* (2006.01)

(52) U.S. Cl.
USPC ..... 401/123; 401/131

(58) Field of Classification Search
USPC ..... 401/118, 123, 124, 125, 131
See application file for complete search history.

(56) References Cited

U.S. PATENT DOCUMENTS

| | | | | | |
|---|---|---|---|---|---|
| 2,828,500 | A * | 4/1958 | Peacock | 401/137 |
| 2,859,463 | A * | 11/1958 | Hirsch | 401/139 |
| 3,008,164 | A * | 11/1961 | Herman et al. | 15/160 |
| 5,558,453 | A * | 9/1996 | Bell et al. | 401/137 |
| 6,302,608 | B1 * | 10/2001 | Holmes et al. | 401/125 |
| D671,013 | S * | 11/2012 | Fritsch | D9/708 |

* cited by examiner

*Primary Examiner* — David Walczak

(57) ABSTRACT

A cleaning bottle has a detachable brush removably secured to the bottle. The cleaning bottle can have a spray head to spray liquid out of the bottle and deliver it to a desired surface, such as a golf club or a golf shoe, for example. The user can them use the brush, either attached to the bottle or after removing it from the bottle, to scrub the surface on which the liquid/cleaner in the bottle has been sprayed. A loop can be disposed on the bottle onto which a fastener, such as a carabineer fastener, can be used for easy transport of the bottle.

1 Claim, 2 Drawing Sheets

GOLF CLUB CLEANER WITH DETACHABLE BRUSH

BACKGROUND OF THE INVENTION

The present invention relates to golf accessories and, more particularly, to a golf club cleaner with a detachable brush.

When cleaning golf clubs, or other items, users either need to carry a separate brush. Some cleaners have a brush built-in, at the spout of the container. In these devices, however, if the brush wears out, the user can no longer use the bottle or the brush.

As can be seen, there is a need for an improved cleaner bottle that can have a detachable brush attached.

SUMMARY OF THE INVENTION

In one aspect of the present invention, a cleaning bottle comprises a spray bottle portion; a spray head removably attached to the spray bottle portion; and a brush removably attached to the spray bottle portion.

In another aspect of the present invention, a cleaning bottle comprises a spray bottle portion; a spray head removably attached to the spray bottle portion; a brush removably attached to the spray bottle portion; one or more channels cut along a back side of the brush; one or more tabs extending from the spray bottle portion, the one or more tabs operable to engage the one or more channels to secure the brush to the spray bottle portion; a retention detent extending from the spray bottle portion; and a detent hole in the brush, where the detent hole aligns with the retention detent to removably secure the brush to the spray bottle portion.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a cleaning bottle having a detachable brush removably secured to the bottle. The cleaning bottle can have a spray head to spray liquid out of the bottle and deliver it to a desired surface, such as a golf club or a golf shoe, for example. The user can them use the brush, either attached to the bottle or after removing it from the bottle, to scrub the surface on which the liquid/cleaner in the bottle has been sprayed. A loop can be disposed on the bottle onto which a fastener, such as a carabineer fastener, can be used for easy transport of the bottle.

Figure 1:
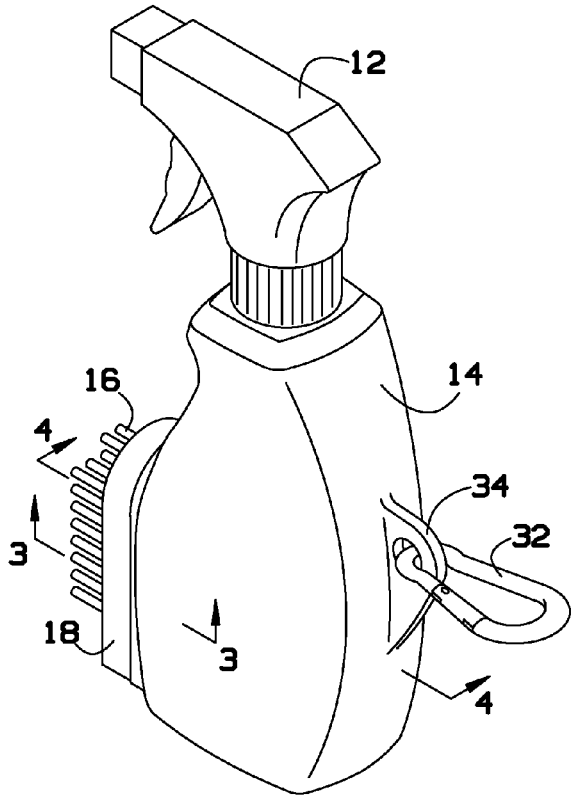
FIG. 1 is a perspective view of a cleaning bottle with a detachable brush, according to an exemplary embodiment of the present invention.
Figure 2:
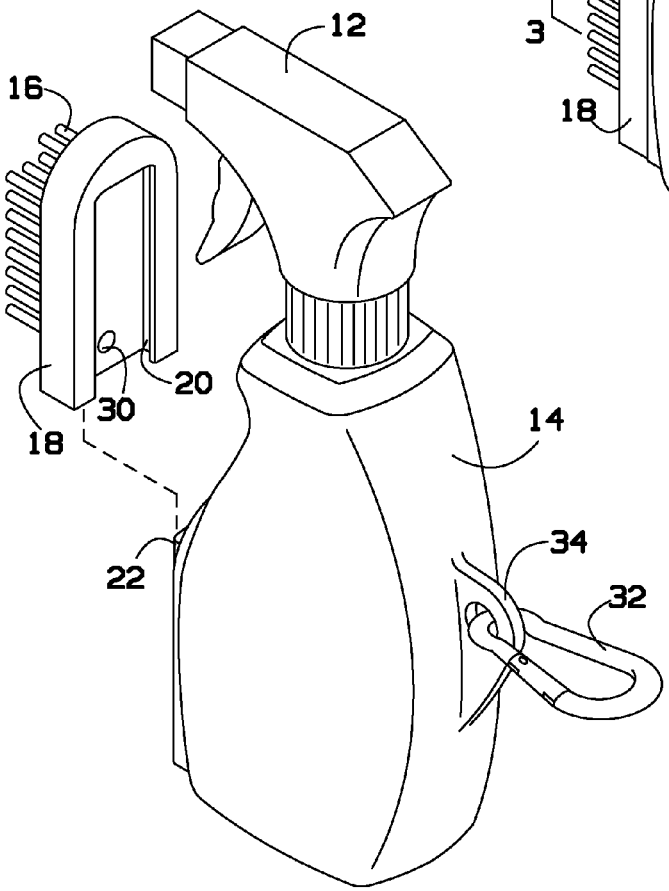
FIG. 2 is a perspective view of the cleaning bottle of FIG. 1 with the detachable brush removed.
Figure 3:
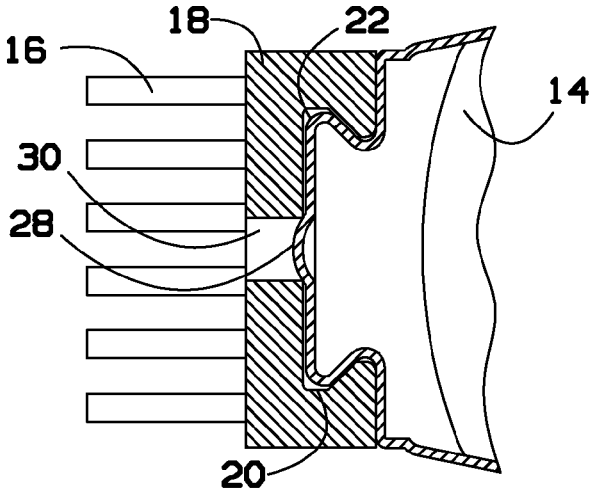
FIG. 3 is a cross-sectional view taken along line 3-3 of FIG. 1 of the cleaning bottle with the detachable brush attached.
Figure 4:
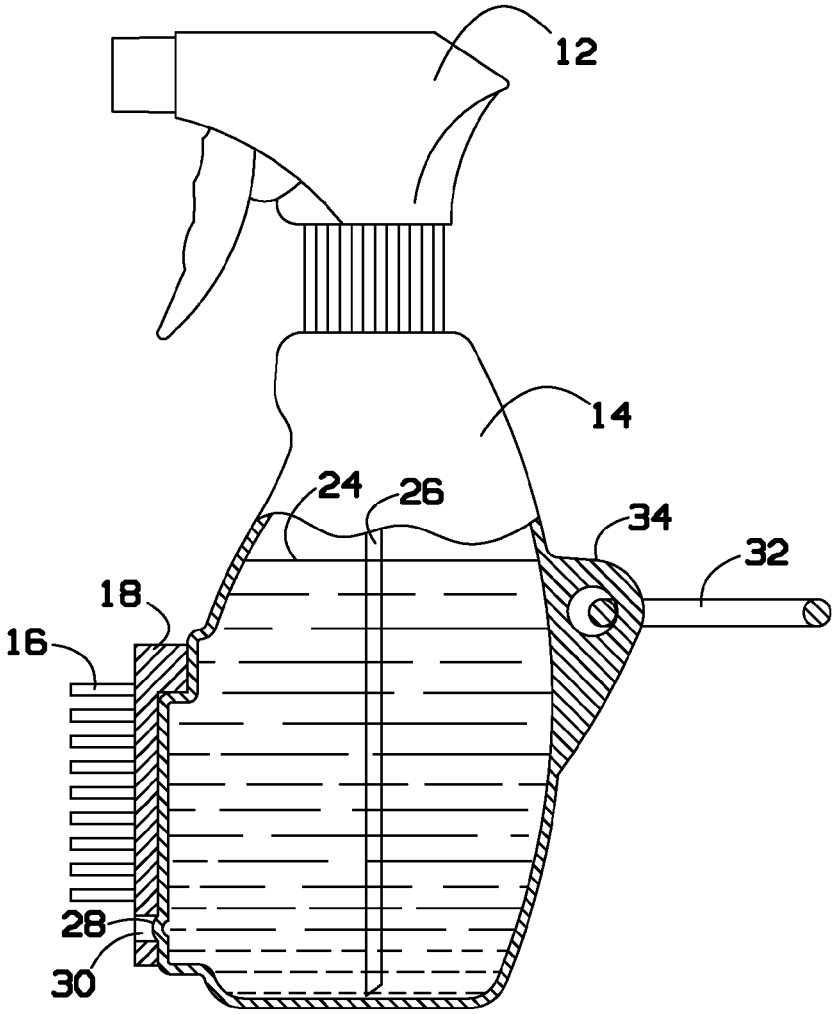
FIG. 4 is a partially cut-away sectional view of the cleaning bottle of FIG. 1 with the detachable brush attached.

Referring to FIGS. 1 through 4, a cleaning bottle can include a bottle portion 14 and a spray head 12 removably attached to the bottle portion 14. A liquid cleaner 24 can be disposed inside the cleaning bottle.

A cleaning brush 18 can be removably attached to the bottle portion 14. The cleaning brush 18 can include a plurality of brush bristles 16. The cleaning brush 18 can include a channel 20 cut along a back side (opposite the brush bristles 16). The channel 20 can include two channels cut along the length of the cleaning brush 18. The spray bottle portion 14 can include one or more tabs 22 operable to fit into the channels 20 on the cleaning brush 16. This channel 20/tabs 22 design can help secure the cleaning brush 18 to the bottle portion 14. In some embodiments, the channel 20 and tabs 22 can be designed as dovetails, but other shapes are within the scope of the present invention.

A retention detent 28 can protrude from the bottle portion 14. The retention detent 28 can align with a detent hole 30 disposed in the cleaning brush. The retention detent 28, when engaged in the detent hole 30, can prevent the cleaning brush 18 from sliding off the bottle portion 14.

An attachment loop 34 can be provided on the bottle portion 14. A fastener, such as a carabineer fastener 32 can fit through the attachment loop 34 to provide a convenient way for carrying the cleaning bottle of the present invention.

The cleaning bottle of the present invention can be used for cleaning various items. A user can simply spray cleaner from the bottle and use the brush to scrub the surface. In some embodiments, the cleaning bottle can be used to clean golf clubs, shoes, or the like. If the brushes become worn, the user can simply purchase a new brush, without needing to purchase an entire cleaning bottle again. This design saves money as well as protects the environment from disposal of entire bottles when only the brush needs replacement.

It should be understood, of course, that the foregoing relates to exemplary embodiments of the invention and that modifications may be made without departing from the spirit and scope of the invention as set forth in the following claims.

What is claimed is:

1. A cleaning bottle comprising:

A bottle portion having opposed front and rear surfaces and opposed side surfaces and adapted to hold a cleaning solution;

a spray head secured to an upper portion of said bottle portion and adapted to spray the cleaning solution out of said bottle portion;

a pair of substantially parallel longitudinally extending tabs secured to said front surface of said bottle portion;

a protruding detent positioned between said tabs;

an attachment loop secured to said rear surface of said bottle portion;

a fastener secured to said attachment loop for enabling a user to carry said cleaning bottle; and a cleaning brush, said cleaning brush including bristles on a front surface thereof, a pair of substantially parallel longitudinally extending channels on a rear surface thereof wherein said channels extend substantially the length of the cleaning brush and a detent hole positioned between said channels and extending through said brush, whereby said cleaning brush is secured to said bottle portion by said channels receiving said tabs and said detent hole engaging said protruding detent.

* * * * *